US008069593B2

(12) United States Patent
McClallen et al.

(10) Patent No.: US 8,069,593 B2
(45) Date of Patent: Dec. 6, 2011

(54) EXCAVATOR BUCKET TOP ASSEMBLY

(75) Inventors: Samuel Lucas McClallen, Yorkville, IL (US); Michael R. Agurkis, Lisle, IL (US); Jeremy Dean Folkerts, Lombard, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/103,726

(22) Filed: Apr. 16, 2008

(65) Prior Publication Data

US 2009/0183398 A1 Jul. 23, 2009

Related U.S. Application Data

(60) Provisional application No. 61/021,736, filed on Jan. 17, 2008.

(51) Int. Cl.
*E02F 3/40* (2006.01)

(52) U.S. Cl. ..... 37/444

(58) Field of Classification Search ..... 37/443, 37/444, 468, 903, 264, 341, 398, 442, 411, 37/379, 403–409, 448; 172/713, 762, 766, 172/540, 553; 414/694, 722; 198/701, 711–714; 299/39.8, 110

See application file for complete search history.

(56) References Cited

U.S. PATENT DOCUMENTS 3,130,843 A * 4/1964 Kelly ..... 37/444
3,243,906 A * 4/1966 Washbond ..... 37/444
3,523,621 A * 8/1970 Anderson et al. ..... 414/704
3,736,675 A * 6/1973 Shankwitz et al. ..... 37/448
3,807,587 A * 4/1974 Maurer ..... 37/444
3,845,870 A * 11/1974 Balderson et al. ..... 37/442
3,860,131 A * 1/1975 Borowski et al. ..... 414/697
3,984,928 A * 10/1976 Oke et al. ..... 37/448
RE29,603 E * 4/1978 Oke et al. ..... 414/722
4,086,712 A * 5/1978 McReynolds ..... 37/444
4,304,058 A * 12/1981 Schwappach ..... 37/444
4,395,193 A * 7/1983 Christensen et al. ..... 414/722
4,449,309 A * 5/1984 Hemphill ..... 37/444
4,477,987 A * 10/1984 Stecklein ..... 37/444
4,523,397 A * 6/1985 Lucas ..... 37/444
RE33,198 E * 4/1990 Ballinger ..... 37/444
5,063,694 A * 11/1991 McCreary, Jr. ..... 37/444

(Continued)

FOREIGN PATENT DOCUMENTS

EP 353454 A1 * 2/1990

(Continued)

OTHER PUBLICATIONS

Four photos of Komatsu excavator buckets taken at the BAUMA trade show in Germany, 2007.

(Continued)

*Primary Examiner* — Robert Pezzuto
(74) *Attorney, Agent, or Firm* — Andrew Ririe

(57) ABSTRACT

An excavator bucket top assembly can be completed as an assembly before being attached to other components to form an excavator bucket. The top assembly includes a flat bottom plate and a top plate with two bends, each having relatively simple geometry for ease of manufacturing. Two hinge plates penetrate through the top plate and are joined to both the bottom plate and the top plate. The top assembly includes strategically positioned, continuous weld joints to avoid weld starts and stops that create stress risers. The top assembly produces a torque tube which is stiff and resistant to fatigue.

14 Claims, 4 Drawing Sheets

U.S. PATENT DOCUMENTS

| | | | | |
|---|---|---|---|---|
| 5,815,959 | A * | 10/1998 | Bahner et al. | 37/444 |
| 6,154,989 | A * | 12/2000 | Kaczmarski et al. | 37/444 |
| 6,233,852 | B1 * | 5/2001 | Pemberton | 37/468 |
| 6,379,075 | B1 * | 4/2002 | Shamblin et al. | 403/322.1 |
| 6,499,904 | B2 * | 12/2002 | Nye | 403/31 |
| 6,581,308 | B1 * | 6/2003 | Woerman et al. | 37/444 |
| 6,865,464 | B2 | 3/2005 | Colburn | |
| D524,826 | S * | 7/2006 | Boyapally et al. | D15/29 |
| D551,684 | S * | 9/2007 | McClallen et al. | D15/32 |
| 2009/0183398 | A1 * | 7/2009 | McClallen et al. | 37/444 |

FOREIGN PATENT DOCUMENTS

| | | | |
|---|---|---|---|
| JP | 58098529 | A * | 6/1983 |
| JP | 59165724 | A * | 9/1984 |
| JP | 05106236 | A * | 4/1993 |

OTHER PUBLICATIONS

Two photos of a Dofi excavator bucket taken in the Netherlands, 2004.
Two photos of a Volvo excavator bucket taken in Brazil, 2006.
One photo of a Reschke excavator bucket taken from the Reschke website, 2007.
One photo of a Case excavator bucket taken at the BAUMA trade show in Germany, 2007.
Three photos of Volvo excavator buckets taken at the BAUMA trade show in Germany, 2007.
One photo of an ESCO excavator bucket taken at the BAUMA trade show in Germany, 2007.
One photo of a Miller excavator bucket taken in the U.S.A., 2004.
Three photos of Liebherr excavator buckets taken at the BAUMA trade show in Germany, 2007.
Two photos of Lemac excavator buckets taken in the Netherlands, 2004.
Two photos of a Reschke excavator bucket taken in Germany, 2005.
Two photos of an Entek excavator bucket taken in the U.S.A., 2002.
Two photos of Entek excavator buckets taken in the U.S.A., 2006.
Two photos of a Eurosteel (ES) excavator bucket taken in the Netherlands, 2005.
One photo of Hensley excavator bucket taken in the U.S.A., 2005.
Diagram of a Geith excavator bucket taken from the Geith website, 2007.
Three photos of Geith excavator buckets taken in the U.K., 2006.
Two photos of AIM excavator buckets taken from the AIM website, 2007.
Two photos of a Hensley excavator bucket taken in the U.S.A., 2001.
Two photos of a Nye excavator bucket taken in Canada, 2006.
Two photos of a Hitachi excavator bucket taken at the BAUMA trade show in Germany, 2007.
One picture of a ZFE excavator bucket taken from the ZFE website, 2007.
Two photos of Weldco-Beales excavator buckets taken in Canada, 2001.
Two photos of a Eurosteel excavator bucket taken in the Netherlands, 2005.
Two photos of Verachtert excavator buckets taken in the Netherlands, 2005.
One photo of a PSM excavator bucket taken in the U.S.A., 2002.
Two photos of a PSM excavator bucket taken in the U.S.A., 2001.
Two photos of a JAWS excavator bucket taken in Australia, 2007.
Two photos of a ZFE excavator bucket taken at the BAUMA trade show in Germany, 2007.
Two photos of a Badger (Paladin) excavator bucket taken in the U.S.A., 2007.
Diagram of a Badger (Paladin) excavator bucket from the Badger website, 2007.
Two photos of a Caterpillar excavator bucket taken in the U.S.A., 2006.
Two photos of an Arden excavator bucket taken in the Netherlands, 2004.
Diagram of a Geith excavator bucket from the Geith website, 2007.
Two photos of a Garier excavator bucket, taken in Canada, 2006.
Three photos and a diagram of Romea excavator buckets from the Romea website, 2007.
Three photos of an ESCO excavator bucket taken in the U.S.A., 2005.
Two diagrams of ESCO excavator buckets from the ESCO website, 2007.
Photo of an ESCO excavator bucket taken at the BAUMA trade show in Germany, 2007.
Three photos of ESCO excavator buckets taken in the U.S.A., 2006.
Photo of a New Holland excavator bucket taken at the BAUMA trade show in Germany, 2007.
Two photos of a Hensley excavator bucket taken in the U.S.A., 2007.
Photo of a Hensley/Komatsu bucket taken in the U.S.A., 2001.
Diagram of a Hensley excavator bucket from the Hensley website, 2007.
Two diagrams of Central Fab excavator buckets from the Central Fab website, 2007.
Three photos of a Badger (Paladin) excavator bucket taken in the U.S.A., 2007.
Four photos of Central Fab excavator buckets taken in the U.S.A., 2007.
Three photos of a Werk-Brau excavator bucket taken in the U.S.A., 2005.
Diagram of a Werk-Brau excavator bucket from the Werk-Brau website, 2007.
Photo of a Werk-Brau excavator bucket taken in the U.S.A. 2007.

* cited by examiner

EXCAVATOR BUCKET TOP ASSEMBLY

This application claims priority to U.S. Provisional Patent Application No. 61/021,736 filed Jan. 17, 2008.

TECHNICAL FIELD

The field of this invention is excavator buckets, and more specifically top assemblies or hinge assemblies for excavator buckets.

BACKGROUND

Excavators, such as the one illustrated in U.S. Pat. No. 6,865,464, can be used in a wide variety of applications: in the construction industry to prepare building sites, in mining to load ore-laden material into trucks or onto conveyors, in road building to make cuts through hillsides for new road beds, in pipe laying and utility work to dig trenches. In all of these operations, excavators employ buckets to penetrate into material in the ground or in a pile, to scoop the material, and then to dump it. The bucket is the implement at the center of performing these tasks.

Excavator buckets are subjected to extreme loads and wear. An excavator bucket on a large excavator could be used to penetrate into extremely hard and dense material such as loosely shot or fractured granite. For this kind of duty, an excavator bucket requires high performance steels and a specialized construction to withstand both the high shock loads, and the extreme abrasive wear. Besides withstanding these maximum load cases and the abrasive environment, an excavator bucket must also be strong enough to endure many thousands, or in some cases, millions of cycles. (A cycle is each repetition of penetrating into the material, scooping, and dumping.) So an excavator bucket also requires resistance to fatigue wear and failure.

If an excavator bucket fails, replacement of the bucket can amount to a great expense in parts and labor. In addition, replacing a bucket will cause the excavator to sit idle and its productivity to decline, resulting in further costs. Besides idling the excavator, a bucket failure can also idle other machines in an integrated operation, such as haul trucks and crushers, further increasing the losses. Thus, a reliable excavator bucket that lasts through many cycles without breaking can be an important requirement for owners of excavator machines.

An excavator bucket can be expensive and difficult to manufacture because of its size and weight and other factors. Excavator buckets are typically constructed as weldments of more than a dozen pieces of plate steel. A bucket for a large, 60 metric ton excavator, for example, can be about 2 meters tall and 2 meters wide, weighing about 5 metric tons. Manipulating these large and heavy pieces of plate steel to align them to one another, and then correctly performing the welds can be a difficult and expensive task. A bucket design which requires a large number of pieces and multiple welds can add to the costs.

Thus, there are many demands affecting the design of an excavator bucket. The design must result in a bucket which exhibits the appropriate performance characteristics of resistance to high loads, abrasion, and fatigue, and which can also be manufactured in an economical manner. To produce a competitive bucket design, a designer must identify design features and techniques to satisfy and balance all of these demands.

SUMMARY

This invention relates to an improved design of a top assembly for an excavator bucket, which satisfies performance and manufacturability demands on the design, resulting in a bucket that is both resistant to failure, and economical to manufacture.

DETAILED DESCRIPTION

Figure 1:
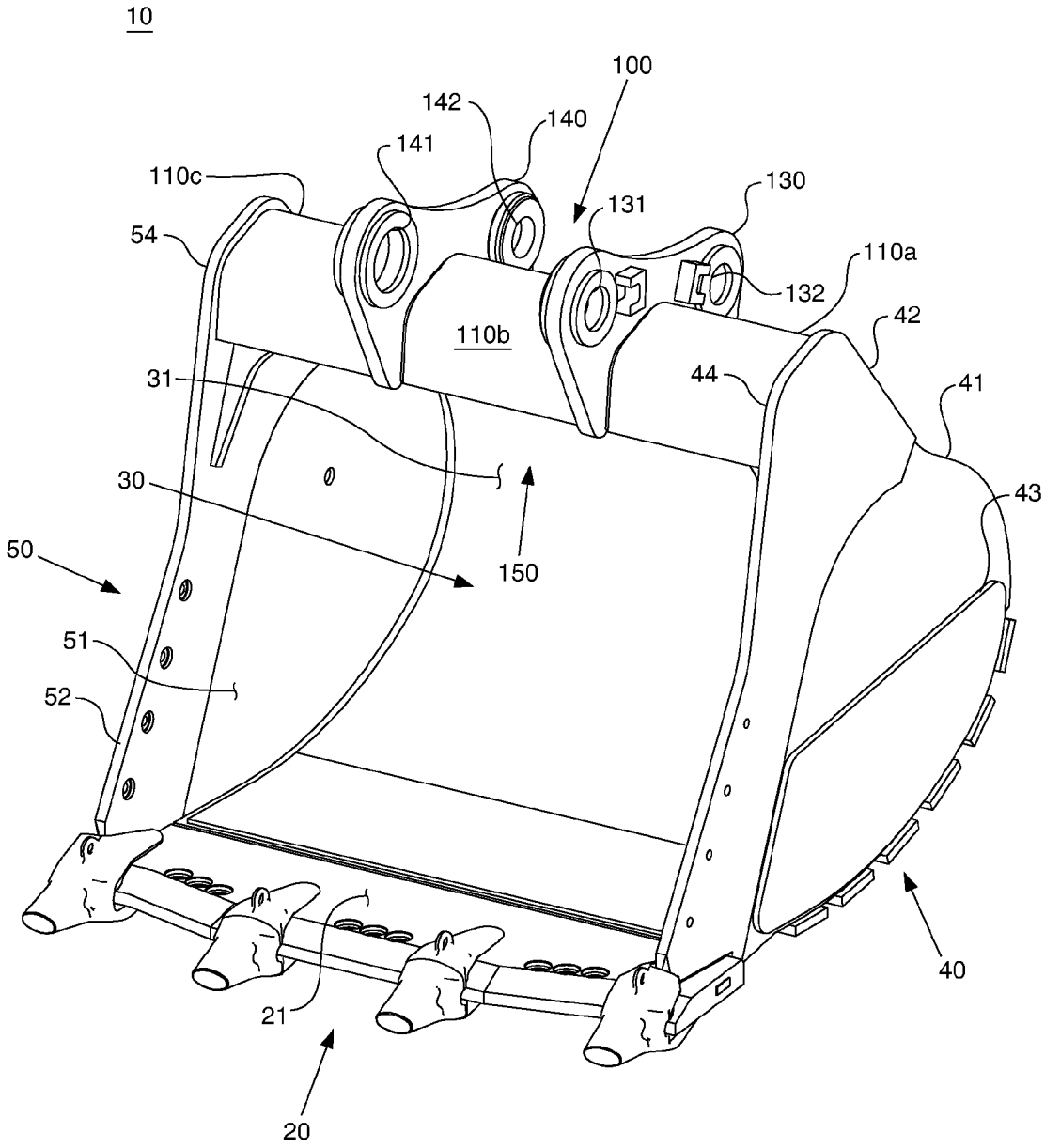
FIG. 1 is a pictorial view of an excavator bucket with an embodiment of the new top assembly.
Figure 2:
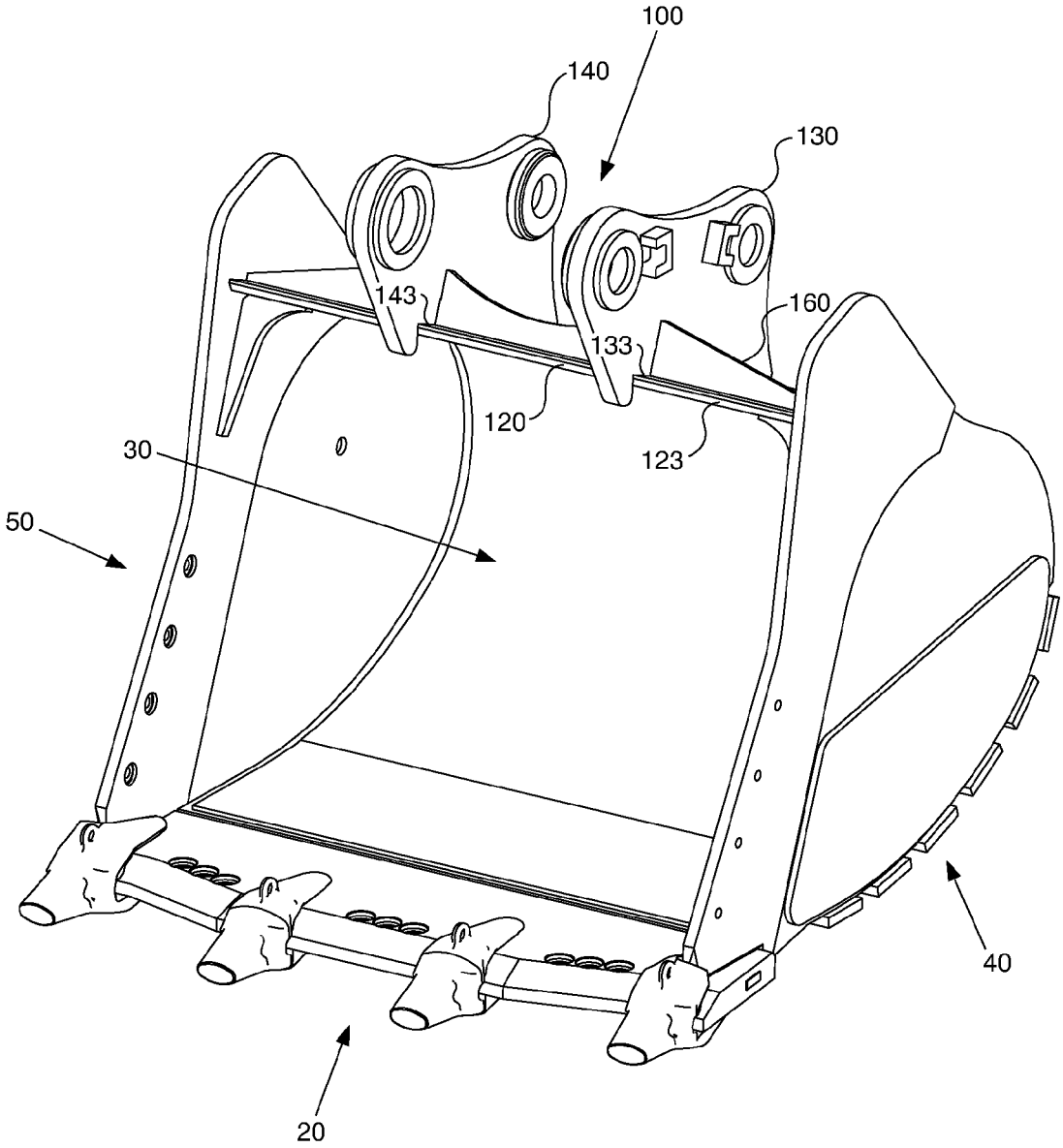
FIG. 2 is the same as FIG. 1, but with the top plate of the top assembly removed to reveal more of the torque tube construction details.

FIGS. 1 and 2 depict an excavator bucket 10 having a bottom section 20 and a curved heel section 30. Normal to the bottom section 20 and heel section 30 are two side sections 40 and 50. The bottom section 20 includes a base edge 21 on which are mounted several adapters, tips, and base edge protectors, which are commonly referred to as ground engaging tools, or GET. One or more steel plates forming a part of the bottom section 20 may be joined to a wrapper 31 which forms a part of the heel section 30. Each side section 40, 50 includes a side plate 41, 51, a side bar 42, 52, and a side wear plate 43, 53. Different basic bucket elements and structure may be used to form the bucket 10, as will be apparent to those of ordinary skill in this art.

Joining the heel section 30 and the side sections 40, 50 is the top assembly (sometimes called hinge assembly) 100. The top assembly includes a top plate 110, a bottom plate 120, and a pair of hinge plates 130, 140.

Figure 3:
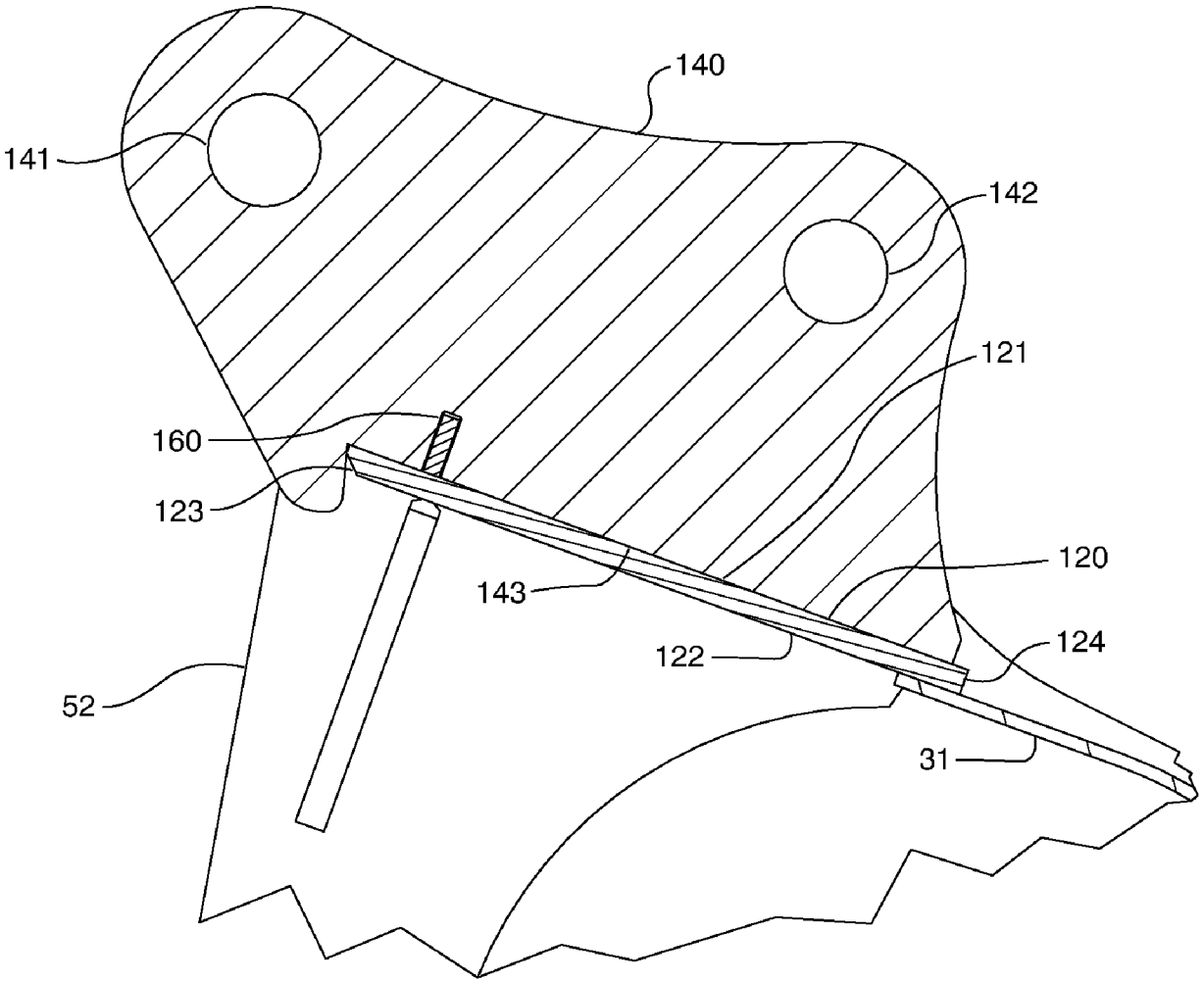
FIG. 3 is a sectional view taken through one of the hinge plates.
Figure 4:
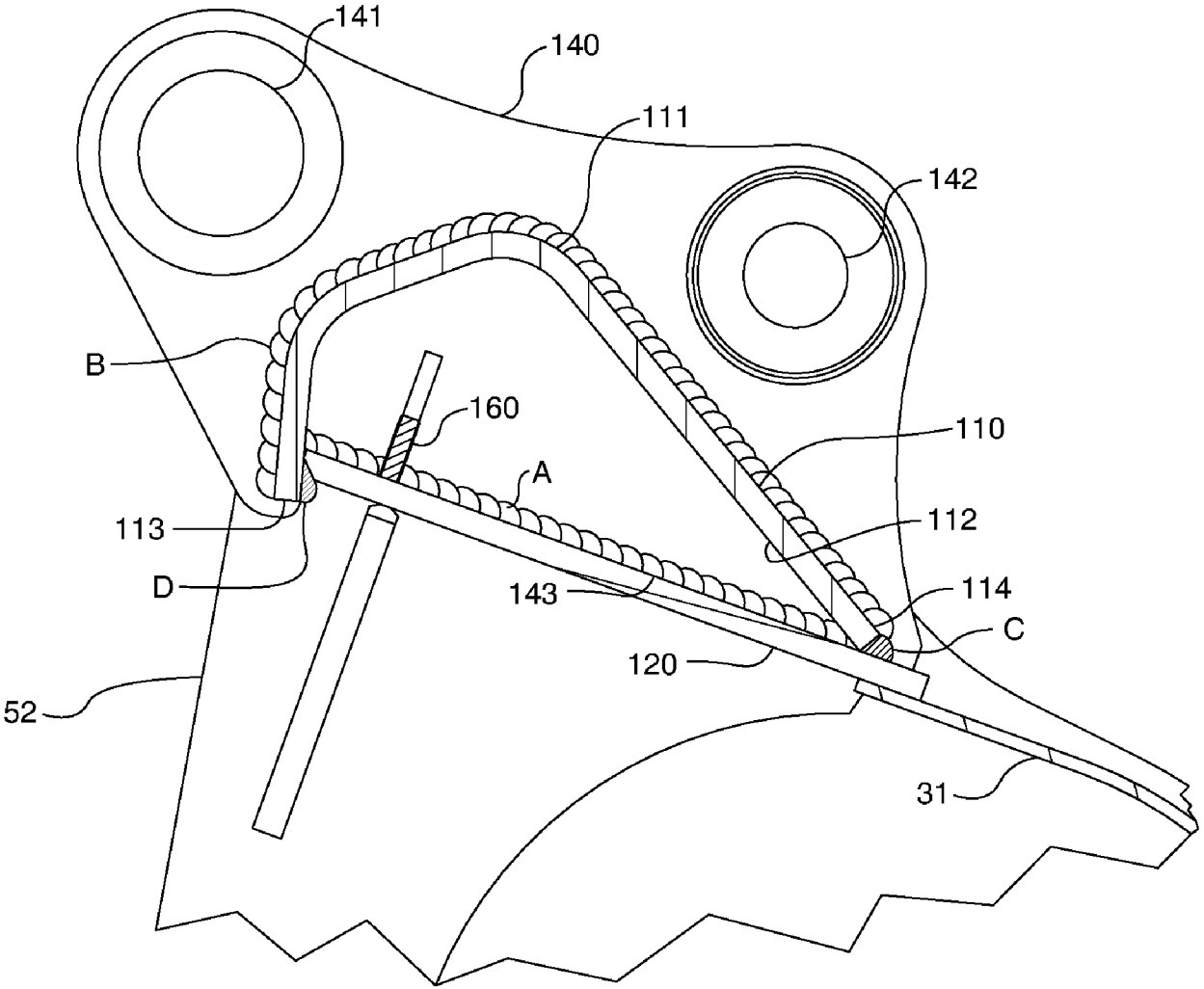
FIG. 4 is a section view taken through the centerline of the bucket.

FIG. 1 depicts the top assembly 100 in an assembled state and joined with the rest of the bucket 10. In this view, the top plate 110 and hinge plates 130, 140 are visible, but the top plate 110 obscures the view of the remaining top assembly 100 structure. In FIG. 2, the top plate 110 has been removed to reveal the underlying structure. FIG. 3 is a sectional view taken through one of the hinge plates 130, 140. FIG. 4 is a sectional view taken through the center of the bucket 10.

The hinge plate 130 includes two bores 131 and 132. Likewise, hinge plate 140 includes two bores 141 and 142. Bores 131 and 141 are axially aligned and will support a stick pin that passes through the stick of the excavator. Bores 132 and 142 are axially aligned and will support a linkage pin that passes through the power link of the excavator which causes the bucket's curling motion about the stick pin. Thus, the hinge plates 130, 140 form two sets of two axially aligned bores (131 and 141 form a first set of two axially aligned bores, and 132 and 142 form a second set of two axially aligned bores).

Elements of the top assembly 100 cooperate to form a torque tube 150. Torque tube 150 is designed to transfer torque from its middle section to its ends. The torque tube 150 functions to transfer "curling" torque about the center of the stick pin created by the power link and linkage pin, to the side sections 40, 50 and the rest of the bucket 10. When the bucket base edge 21 penetrates into material, the force propelling the base edge is transferred to the base edge in part by this torsional force created about the stick pin by the power link. In addition to torque, a variety of other load paths exist through the torque tube 150. The torque tube 150 must be capable of transferring all of these large sustained and shock loads and torques. The torque tube is formed in part through joining the top plate 110, bottom plate 120, and hinge plates 130, 140 to form a rigid, tube-like structure.

The top plate 110 defines a top surface 111, a bottom surface 112, a front edge 113, and a rear edge 114. The bottom plate 120 defines a top surface 121, a bottom surface 122, a front edge 123, and a rear edge 124. The bottom surface 112 and the top surface 121 are part of the inside surfaces of the generally enclosed torque tube 150. The top surface 111 and the bottom surface 122 are part of the outside surfaces of the torque tube 150.

The bottom plate 120 is formed from flat steel plate stock. For ease of manufacturing, the bottom plate 120 may not include any bends, nor any relatively complex cuts or shapes formed in it.

The top plate 110 is also formed from flat steel plate stock. The top plate 110 may include two bends, with a first bend having an included angle of approximately 105-125°, and more specifically approximately 115°, and a second bend having an included angle of approximately 100-120°, and more specifically approximately 110°. Each bend is approximately parallel to the front edge 113 of the top plate 110. Each of the included angles faces toward the bottom plate 120 when assembled to help form the enclosed, tube-like structure of torque tube 150. The outside surface profile of torque tube 150 created by these bends in top plate 110 helps the torque tube to be effectively positioned relative to certain existing, traditional quick couplers which may be used to attach bucket 10 to an excavator. The top plate 110 may easily be formed by first cutting its shape from plate stock, and then by creating the bends in a brake press or other type of press. Although the top plate may include two bends, it is still relatively easy to manufacture because it does not require any complex shapes or machining.

The assembly of top assembly 100 can begin by attaching hinge plates 130, 140 to bottom plate 120 so that the hinge plates are parallel to one another and normal to the bottom plate. Each of the hinge plates includes a flat bottom edge 133, 143 which butts against and is welded to the top surface 121 of bottom plate 120. One of these weld joints is illustrated in FIG. 4 with the reference character A. Each of the flat bottom edges 133, 143 is approximately the same length as the distance between the front edge 123 to the rear edge 124. Thus, the hinge plate 130, 140 to bottom plate 120 butt joint extends approximately from the front edge 123 to the rear edge 124. Advantageously, the butt joint need not extend beyond the rear edge 124 (as it does in some prior art designs where the hinge plates 130, 140 also are joined to the wrapper 31) in order to permit joining the hinge plates 130, 140 to bottom plate 120 in an assembly which can be fully completed before being joined to the rest of bucket 10.

Optional rib or ribs 160 may be included between hinge plates 130, 140 and bottom plate 120. The rib 160 may reinforce the connection between the hinge plates 130, 140 and the bottom plate 120, add stiffness to the torque tube 150, as well as aid in maintaining alignment during welding and assembly. Both the hinge plates 130, 140 and the rib 160 may include a slot cut in each—a portion of the rib fitting into the slot in each hinge plate, and vise versa—forming an interlocking halved joint therebetween. The rib 160 may be welded to the hinge plates 130, 140 and to the bottom plate 120 around the same time as welding between the hinge plates and the bottom plate.

Hinge plates 130, 140 may pass through and divide the top plate 110. This allows hinge plates 130, 140 to be welded to the bottom plate 120 as well as the top plate 110, forming a stronger and stiffer torque tube 150. Some prior art designs do not have hinge plates which are welded to both a top plate and a bottom plate, having instead hinge plates which are only welded to a top plate, which results in a weaker torque tube. Hinge plates 130, 140 may divide the top plate 110 into three separate segments 110*a*, 110*b*, and 110*c*. Segments 110*a* and 110*c* are outboard of the hinge plates, meaning they are between one of the hinge plates and one of the sides of the bucket 10. Segment 110*b* is inboard of the hinge plates, or between the two hinge plates in the middle of the bucket 10. The hinge plates 120, 130 and segments 110*a*, 110*b*, and 110*c* are welded at a weld joint formed at their intersection and along the top surface 111. One of these weld joints is illustrated in FIG. 4 with the reference character B.

Top plate 110 and bottom plate 120 are joined to each other along a first and a second weld joint. A first weld joint may be formed at the intersection of the rear edge 114 of top plate 110 and the bottom plate 120, along the top surface 121. This weld joint is illustrated in FIG. 4 with the reference character C. The bottom plate 120 may overlap the top plate 110 (i.e. the bottom plate extends further than the intersection of the top plate and bottom plate, and the top plate terminates at the intersection) to permit this joint. Because the rear edge 114 is joined to the bottom plate 120, and does not extend further to intersect or join with wrapper 31, the assembly between the top plate 110 and bottom plate 120 can be completed before the top assembly 100 is joined to the remainder of bucket 10.

A second weld joint may be formed at the intersection of the front edge 123 with the top plate 110, along the bottom surface 112. This weld joint is illustrated in FIG. 4 with the reference character D. In order to make this joint, the top plate 110 may overlap the bottom plate 120. This construction advantageously permits this weld joint to be made with a continuous, non-interrupted welding pass from one end of torque tube 150 to the other. In other prior art designs where the bottom plate 120 overlaps the top plate 110, this weld joint is formed at this intersection but on the top surface 121, and the weld joint is segmented or broken because it is interrupted by the hinge plates. It has been determined by the inventors that the breaks in this second weld joint result in weak areas, or stress risers, which are an important cause of bucket failures. By eliminating the weld starts and stops in this second weld joint, the stress risers are minimized and the bucket is stronger. This second weld joint resides in a high load path region of the torque tube 150, so minimizing stress risers in this region is very beneficial.

The foregoing construction of the top assembly 100 permits it to be completely assembled as an independent module before attaching to the remaining components of the bucket. Constructing the top assembly 100 as an independent module can present several advantages. The many welds in the top assembly 100 can all be performed before attaching the remaining components of bucket 10. The top assembly 100 is smaller and lighter than the entire bucket 10 so the top assembly is easier to move around and position, making these welds simpler to perform.

Bores 131, 132, 141, and 142 formed in hinge plates 130, 140, typically require tight tolerances. Traditionally, these bores are formed through machining after the hinge plates have been fixed to the bucket. Because hinge plates 130, 140 are completely assembled into the top assembly 100, these bores 131, 132, 141, and 142 can be machined after top assembly 100 is assembled, but before top assembly 100 is joined to the rest of the bucket. Positioning top assembly 100 on a boring machine for making these bores can be a much simpler task than positioning the entire bucket 10 on a boring machine, and a smaller boring machine may be used.

For manufacturing workflow, the top assembly 100 can be completed and then wait for the remaining components to be gathered together for assembly into the final bucket 10. The top assembly 100 can even be designed to work as a top assembly for more than one size and/or type of bucket. So a single top assembly 100 can be constructed and then fit to different remaining components to form a variety of buckets.

After the top assembly 100 is assembled, it can be attached to the heel section 30 and side sections 40, 50. The wrapper 31 is welded to the bottom plate 120. The side bars 42, 52 include ears 44, 54, which overlap the ends of the torque tube 150. The ends of torque tube 150 are welded to these ears 44, 54. A fully assembled bucket 10 is illustrated in FIG. 1.

INDUSTRIAL APPLICABILITY

The foregoing excavator bucket top assembly may be used in the construction of excavator buckets for use in many industries including construction and mining.

We claim:

1. A top assembly for an excavator bucket comprising:

a bottom plate having a front edge, a rear edge, a top surface, and a bottom surface;

a first hinge plate and a second hinge plate each having a bottom edge approximately the same length as the distance between the front edge and the rear edge of the bottom plate, each hinge plate being normal to and butted against-the bottom plate along their respective bottom edges approximately from the front edge to the rear edge plate of the bottom plate, the two hinge plates positioned parallel to one another and each featuring two bores, each of the bores on one hinge plate combining with one of the bores on the other hinge plate to form two sets of two axially aligned bores;

a top plate normal to the first hinge plate and the second hinge plate and having a front edge, a rear edge, a top surface, and a bottom surface, the top plate comprising three sections divided from one another by one of the hinge plates with a first section positioned on an outboard side of the first hinge plate, a second section positioned inboard of the first hinge plate and the second hinge plate, and a third section positioned outboard of the second hinge plate;

a first weld joint joining the top plate and the bottom plate, the first weld joint formed proximate the rear edge of the top plate and the rear edge of the bottom plate, and formed on the top surface of the bottom plate; and a second weld joint joining the top plate and the bottom plate, the second weld joint formed proximate the front edge of the top plate and the front edge of the bottom plate, and formed on the bottom surface of the bottom plate.

2. A top assembly according to claim 1 wherein the top plate, bottom plate, first hinge plate, and second hinge plate are joined together to form a torque tube for transferring torque from the middle of the torque tube to its ends.

3. A top assembly according to claim 2 wherein the second weld joint is continuous from one end of the torque tube to the opposite end.

4. A top assembly according to claim 1 wherein the entire bottom plate is flat.

5. A top assembly according to claim 1 wherein the top plate comprises a first bend and a second bend, each of the first bend and the second bend being formed approximately parallel to the front edge of the top plate.

6. A top assembly according to claim 5 wherein the first bend has an included angle of approximately 115 degrees, and the second bend has an included angle of approximately 110 degrees.

7. An excavator bucket comprising:

a first side section and an opposite second side section;

a curved heel section normal to and extending between the first side section and the second side section;

a top assembly joining and fixed to the first side section, the second side section, and the curved heel section, the top assembly including:

a flat bottom plate having a front edge, a rear edge, a top surface, and a bottom surface;

a first hinge plate and a second hinge plate each having a bottom edge, each hinge plate being normal to and butted against and welded to the bottom plate along their respective bottom edges, each bottom edge spanning approximately from the front edge to the rear edge of the bottom plate, the two hinge plates positioned parallel to one another and each featuring two bores, each of the bores on one hinge plate combining with one of the bores on the other hinge plate to form two sets of two axially aligned bores;

a top plate having a front edge, a rear edge, a top surface, and a bottom surface, the top plate comprising three sections divided from one another by one of the hinge plates, with a first section positioned on an outboard side of the first hinge plate, a second section positioned inboard of the first hinge plate and the second hinge plate, and a third section positioned outboard of the second hinge plate;

the top plate overlaps the front edge of the bottom plate;

a first weld joint joining the top plate and the bottom plate, the first weld joint formed on the top surface of the bottom plate at the intersection of the rear edge of the top plate with the bottom plate; and a second weld joint joining the top plate and the bottom plate, the second weld joint formed on the bottom surface of the bottom plate at the intersection of the front edge of the bottom plate with the top plate.

8. An excavator bucket according to claim 7 wherein the second weld joint extends continuously from the first side section to the second side section.

9. An excavator bucket according to claim 8 wherein the top plate, bottom plate, first hinge plate, and second hinge plate are joined together to form a torque tube for transferring torque from the middle of the torque tube to its ends.

10. An excavator bucket according to claim 8 wherein the top plate has at least a first bend formed therein parallel to the front edge of the top plate.

11. An excavator bucket according to claim 8 wherein the top plate has a first bend and a second bend formed therein, with each of the first bend and the second bend being approximately parallel to the front edge of the top plate.

12. An excavator bucket according to claim 11 wherein the first bend has an included angle of between 105 to 125 degrees, and the second bend has an included angle of between 100 and 120 degrees.

13. An excavator bucket according to claim 7 wherein the first hinge plate and a second hinge plate are not directly attached to the curved heel section.

14. An excavator bucket according to claim 7 wherein the bottom plate overlaps and is welded to a portion of the curved heel section.

* * * * *